United States Patent [19]

Goller et al.

[11] Patent Number: 4,535,609

[45] Date of Patent: Aug. 20, 1985

[54] YARN TENSION DEVICE FOR A FLAT KNITTING MACHINE

[75] Inventors: Ernst Goller, Reutlingen; Fritz Walker, Kusterdingen, both of Fed. Rep. of Germany

[73] Assignee: H. Stoll GmbH & Company, Fed. Rep. of Germany

[21] Appl. No.: 589,248

[22] Filed: Mar. 13, 1984

[30] Foreign Application Priority Data

Mar. 21, 1983 [DE] Fed. Rep. of Germany ..... 3310132

[51] Int. Cl.[3] ..... D04B 15/44

[52] U.S. Cl. ..... 66/146; 242/150 R

[58] Field of Search ..... 66/146; 242/150 R

[56] References Cited

U.S. PATENT DOCUMENTS 2,178,981 11/1939 Wachsman ..... 242/150 X
2,246,989 6/1941 Sparkes ..... 242/150
2,661,913 12/1953 Heizer et al. ..... 242/150

FOREIGN PATENT DOCUMENTS 644028 8/1962 Italy ..... 242/150

*Primary Examiner*—Ronald Feldbaum
*Attorney, Agent, or Firm*—Jones, Tullar & Cooper

[57] ABSTRACT

A disc type tensioning, or braking device for a float heel knitting machine.

24 Claims, 10 Drawing Figures

YARN TENSION DEVICE FOR A FLAT KNITTING MACHINE

This invention relates to a yarn tension device for a flat knitting machine.

Typically, such a device comprises a yarn brake having a pair of juxtaposed brake plates between which the yarn is passed in use, at least one of the brake plates being urged against the other by spring pressure. However, in yarn tension devices of this type, problems can arise in the region of the yarn brake itself and/or upstream of the brake with respect to the direction of yarn movement, insofar as yarns which are difficult to work (such as knopyarns) can jump out of the brake: such jumping-out can also be caused by an unsteady run of the yarn or by accumulations of or loops in the yarn, for example. In order to prevent this, it has been the conventional practice to use yarn guide loops. However, in order to function efficiently, these loops must be disposed at a relatively short distance from the brake so that considerable skill is required and considerable time taken up to thread the yarn in.

A changeover has however recently been made, not only in the area of the yarn brake but also in other areas of the yarn tension device, to the use of elements in place of the yarn guide loops which enable so-called open threading of the yarn. German OS No. 29 36 581 discloses an example of this where the yarn is introduced into the individual yarn tension elements not by being threaded in at the end side into a loop, but rather by being put in on the longitudinal side thereof. In order to stop the yarn from jumping out of the brake, at least as far as possible, instead of placing the brake at a point in the course of a mainly straight run of yarn, it has been put lower and thus a deflection of the course of the yarn is achieved which should effect a tension on the yarn which is directed inside the brake. However, it has been found necessary to make a compromise here because the advantage of placing the brake far down for the purpose of better holding the yarn inside the brake, is out-weighed to a certain extent by the disadvantage arising from the considerable braking effect imposed due to the increased looping angle of the yarn on the axis of the brake. It has therefore not been possible to place the thread brake as far down as it should have been to ensure that the yarn could not jump out, for otherwise there would have been a risk of tearing the yarn and/or of a reduced brake adjustment. Accordingly, it has not been possible with yarn tension devices designed for completely open threading completely to prevent the yarn from coming out of the brake.

An object of the present invention is therefore to create a yarn tension device of the type described above which completely prevents the yarn from becoming inadvertently unthreaded over all of the component parts (including the yarn brake) without other disadvantages having to be incurred, and which thus ensures reliable functioning of the flat knitting machine to which the yarn tension device is fitted.

Accordingly, the present invention provides a yarn tension device for a flat knitting machine, comprising a yarn brake having a pair of juxtaposed brake plates between which the yarn is passed in use, at least one of the brake plates being urged against the other by spring pressure, and a securing device which defines a yarn path between the brake plates, the securing device permitting open threading of the yarn into the yarn path but automatically closing the access to the yarn path after the yarn has been inserted therein.

The yarn tension device of the invention thus makes it possible for the yarn to be threaded in openly into the yarn brake and also into all of the other components as before from the peripheral side and by means of the longitudinal course of the yarn. At the same time it is safely ensured that the yarn cannot inadvertently leave the thread brake again because the securing device has automatically reclosed the yarn path, into which the yarn has been laid, in a radial direction towards the outer circumference. The position of the yarn brake can thus be shifted upwards as compared with the above-described conventional arrangement, so that it can be placed in the course of a yarn path running in an essentially straight line, with the result that the looping angle (which increases the braking effect) can be made negligibly small. It has been found that even a loop or such like in the yarn, formed for instance when the machine has been shut down, cannot lead to the yarn becoming unthreaded from the yarn brake.

In a preferred embodiment of the present invention, the securing device is formed by at least one securing projection standing away from one of the brake plates, said projection being provided towards the outer periphery of the brake plate with an oblique surface which projects into a receiver in the opposing brake plate, and the brake plates are movable relative to one another to open and close the yarn path. This is a very simple design arrangement in which it is ensured that the yarn can be brought in over the oblique surface from the outside to the inside, whereby when the yarn slides away over the oblique face of the securing projection, the latter is freed out of the receiver.

In a variant of this, at least one of the brake plates is provided with an inner recess to form an outer annular brake edge, and it is expedient if the oblique face of the securing projection extends to below this brake edge. This ensures with certainty that with open threading the relevant yarn comes up against the oblique face of the securing projection and can slide along the same.

Advantageously, the securing projection is fixed relative to said one of the brake plates, and the brake plate which has the receiver is movable in opposition to the action of a pressure spring. The securing projection itself can be designed in various ways. Thus, in one embodiment the securing projection is fixed as a (for example) wedge-shaped element on said one of the brake plates or on a brake plate holder lying behind said one of the brake plates, and engages in an opening in the outer brake plate. In another embodiment, the securing projection is formed as a stamped-out shape on the relevant brake plate, which is itself formed from sheet metal, and engages either in an opening or an impression on the opposing brake plate. In a further embodiment, the securing projection is in the form of an upwardly bent blade element which has been stamped out of the base of the relevant brake plate (again shaped from sheet metal) and which also engages either in an impression or a stamped-out orifice on the opposing brake plate. The securing projection can also be a curved wire strap.

In a still further embodiment, the securing projection extends over a certain acute angle area along a circular arc on the respective brake plate. This can be realised by designing the securing projection as an elongated, circular nose or by forming the securing projection from two (for example) round noses disposed at a distance on the arc of a circle. In this way, the yarn can be threaded in and held safely inside the yarn path, the formation of fairly large loops in the yarn is prevented, and a small yarn looping angle which always remains constant is ensured.

In a preferred example of the present invention, twist prevention means is provided between the two brake plates, the twist prevention means facing towards the securing projection. This too helps the yarn to be threaded in safely and held in a locked manner in the yarn path because the two brake plates are prevented from twisting relative to one another and thus it is always guaranteed that the securing projection can fall back into its receiver on the opposing brake plate without further ado after the yarn has been threaded in.

The present invention will now be further described, by way of example only, with reference to the accompanying drawings, in which.

Figure 1:
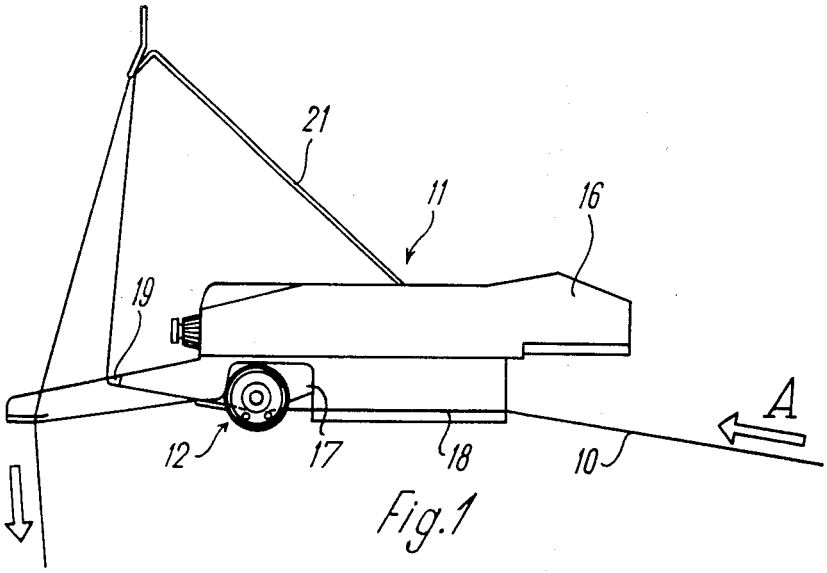
FIG. 1 is a side view of one embodiment of a yarn tension device according to the present invention.

In all of the various embodiments described herein, there is provided a yarn tension device 11 which carries a yarn 10 in such a manner that open threading of the yarn is possible, i.e. the yarn can be inserted from its longitudinal side into the device 11. The device includes a yarn brake 12 provided with a securing device 13 which prevents with certainty the yarn 10 from becoming unthreaded out of the brake 12 during operation. Although not shown as such in the drawings, the yarn tension device 11 is designed to be fitted to a flat knitting machine.

Figure 2:
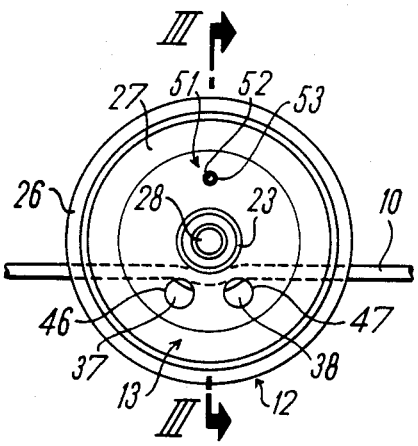
FIG. 2 is an enlargement of part of FIG. 1.
Figure 3:
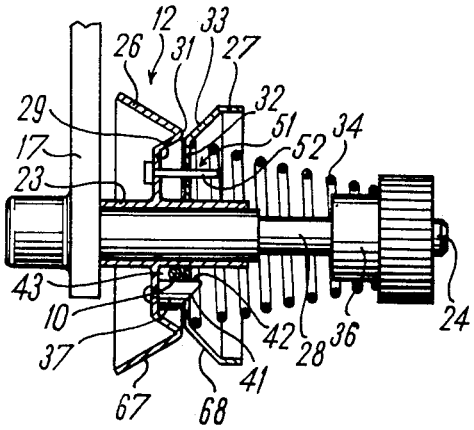
FIG. 3 is a section taken along the line III—III in FIG. 2.

In the yarn tension device shown in FIGS. 1 to 3, a housing 16 has disposed on its underside a holder 17 for the brake 12. A yarn guide 18 is positioned before the brake 12 in the direction of movement of the yarn, indicated by arrow A, the yarn guide 18 also being disposed on the underside of the housing 16. The guide 18 allows the yarn 10 to run in an approximately horizontal direction to the brake 12. From the brake, the yarn 10 passes via a deflection unit 19 to a spring gripping arm 21 into which the yarn 10 can also be openly threaded. At the arm 21, the yarn is deflected into almost the opposite direction and is passed to a further thread guide (not shown). The arm 21 is pretensioned by means of the thread running there-through, and is connected to mechanical and/or electrical control elements inside the housing 16 which effect a switching off of the flat knitting machine in the event of the yarn breaking and subsequent spring-back of the arm 21.

As can be seen from FIGS. 2 and 3, the yarn brake 12 comprises two mutually opposed brake plates 26 and 27 which are lined up on a shaft 28 fixed so that it stands at right-angles to the holder 17. The two brake plates 26 and 27 are each designed as a dome-shaped sheet metal part, with the brake plate 26 (which is adjacent to the holder 17) possessing an annular hollow 29 surrounded concentrically by an annular brake edge 31 defined or formed on both the outside and the inside by a diagonally running wall. The brake plate 27, which is opposite the hollow 29 and the annular brake edge 31 of the brake plate 26, has a level annular wall 32 which at the edge merges with a conically returning shoulder 33. The outside diameter of the annular wall 32 is a little smaller than the diameter of the annular brake edge 31, so that the edge 31 lies opposite to the starting area of the shoulder 33 adjacent to the annular wall 32. A pressure spring 34 acts at one end thereof on the inside of the annular wall 32 of the brake plate 27, the other end of the spring 34 lying against an internally threaded bolt 36 which is screwed onto external threading on a free end 24 of the shaft 28. By suitably twisting the bolt 36 relative to the shaft 28, the pretension imposed by the spring 34 on the brake plate 27 can be adjusted. The pressure spring 34 is of conical design. In the illustrated construction, the brake plate 26 is held against rotation relative to the shaft 28 by means of a sleeve 23, while the brake plate 27 is mounted on the sleeve 23 so that it is both rotatable and movable axially relative to the shaft 28.

In the embodiment of FIGS. 1, 2 and 3, the aforementioned securing device 13 is formed by two securing noses 37 and 38 of identical design which are spaced apart from one another along the arc of a circle. Each nose 37, 38 is of approximately wedge-shaped design and possesses therefore a lead-in or oblique face 41 which faces the outer periphery of the yarn brake 12. A boundary face 42 is provided, facing away from the oblique face 41 and towards the shaft 28, which stands away from the base of the hollow 29 of the brake plate 26 in either perpendicular or slightly inclined fashion. The securing noses 37 and 38 are of circular section (although they may be of oval design) and are secured for instance by means of a rivet on the base of the hollow 29 at a distance from the shaft 28 or the sleeve 23, whereby a sufficient gap 43 is left for the yarn or yarns which are to be used. The oblique face 41 is disposed on each securing nose 37, 38 such that is starts in an area below the plane of the annular brake edge 31. In the other brake plate 27 and at positions opposite to the securing noses 37 and 38, a pair of receivers in the form of respective bores 46 and 47 are provided, into which the securing noses 37 and 38 respectively penetrate. The length of the securing noses 37 and 38 is determined such that they will still penetrate through the bores 46 and 47 even when the yarn 10 is running between the brake plates 26 and 27. This means that the brake plate 27 can be moved away from the brake plate 26 by approximately the thickness of the yarn 10, as shown in FIG. 3. Both of the securing noses 37 and 38 have a gap which gives an acute looping angle of the yarn 10 on the shaft 28 or the sleeve 23, which is still to be presented. An anti-rotation device 51 is disposed approximately diametrically opposite to the securing noses 37 and 38. The device 51 comprises a pin 52 which is fixed to and which projects out of the bottom of the hollow 29, and a bore 53 in the opposing brake plate 27 into which the pin 52 extends. The pin 52 is longer than the securing noses 37 and 38, so that in the event of the securing noses 37 and 38 becoming disengaged from the bores 46 and 47 in the opposing brake plate 27 while the yarn is being threaded in, the pin 52 prevents the brake plate 27 from being turned.

Figure 4:
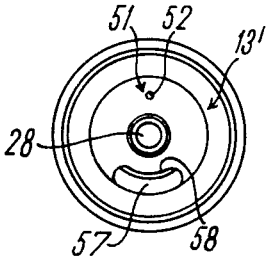
FIG. 4 is a plan view of a second embodiment of a yarn tension device according to the present invention.
Figure 5:
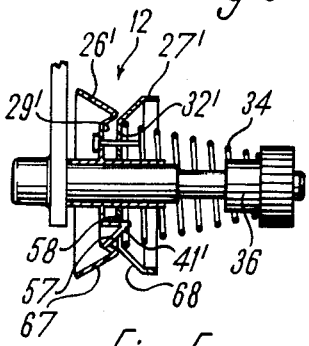
FIG. 5 is a section through the device shown in FIG. 4.

The embodiment shown in FIGS. 4 and 5 uses brake plates 26' and 27' which are designed essentially like the brake plates 26 and 27 of FIGS. 2 and 3. For this reason, only the difference therebetween will be described. In FIGS. 4 and 5, the securing device 13' is constructed as a securing comb 57 of circular shape, the comb enclosing approximately the same acute angle as the two securing noses 37 and 38. The securing comb 57 is formed as a stamped-out part which projects out of the bottom of the hollow 29' in the direction of the other brake plate 27', and which engages in a corresponding circular recess 58 in the brake plate 27'. The recess 58 can be provided in the form of an impression in the wall 32' of the brake plate 27'. Alternatively, the securing comb 57 could be constructed as a separate part like the securing noses 37 and 38, and could be secured to the base of the hollow 29'. Similarly, the securing noses 37 and 38 in FIGS. 2 and 3 could also be stamped out of the bottom of the hollow 29 so as to project therefrom.

Figure 6:
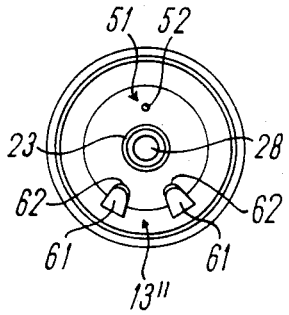
FIG. 6 is a plan view of a third embodiment of a yarn tension device according to the present invention.
Figure 7:
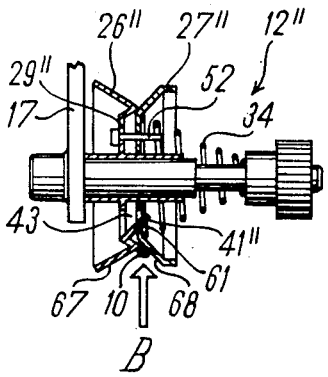
FIG. 7 is a section through the device shown in FIG. 6.

The same applies for the embodiment shown in FIGS. 6 and 7, i.e. the thread brake 12" with its brake plates 26" and 27" is in principle the same as the thread brake 12 with the brake plates 26 or 26' and 27 or 27' respectively. The only difference is that the securing device 13" is formed by two securing lugs 61 which are disposed at a distance from one another and which are stamped out of the base of the hollow 29". These lugs 61 are upwardly bend and penetrate into recesses 62 in the opposing brake plate 27". The operation for threading the yarn into the tension device of FIGS. 6 and 7 will now be described, it being understood that a similar operation is employed mutatis mutandis for the other embodiments described above. In this operation, the yarn 10 is introduced by means of its longitudinal side in the direction of arrow B from the outer peripheral area of the yarn brake 12" between the two brake plates 26" and 27". Since the brake plates have lead-in slopes 67 and 68 pointing towards their dividing plane, the yarn 10 is able to prise the two brake plates apart and come up against the oblique face 41" of one of the securing lugs 61. The yarn 10 can slide along this oblique face 41", whereby the brake plate 27" is moved away from the brake plate 26" against the action of the pressure spring 34, and indeed until the securing lugs 61 are released from the recesses 62. Following this the yarn 10 is able to slip behind the oblique face 41" and thus behind the securing lugs 61 towards the base of the hollow 29", so that the brake plate 27" follows under the action of the pressure spring 34. Because the anti-rotation device 51 prevents the brake plate 27" from rotating at this time, the securing lugs 61 can penetrate into the recesses 62 again. The yarn path is now locked and cannot be opened again through any of the possible movements of the yarn, because there is no oblique face available from this side.

Figure 8:
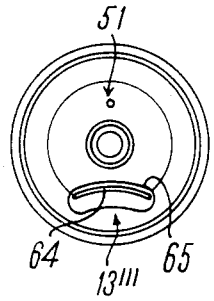
FIG. 8 is a plan view of a fourth embodiment of a yarn tension device according to the present invention.
Figure 9:
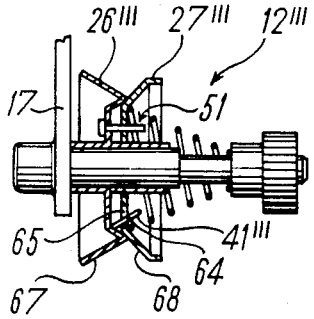
FIG. 9 is a section through the device shown in FIG. 8.

FIGS. 8 and 9 show a fourth embodiment of the invention: as before, only the differences compared with the previous embodiments will be described. In the yarn brake 12''' of FIGS. 8 and 9 the securing device 13''' has a wire loop or strap 64 fixed on the brake plate 26'''. The strap 64 is shaped like a bridge and slopes toward the shaft 28 so that the two end portions thereof form a lead-in slope 41''' for the yarn 10. The strap 64 engages in an approximately banana-shaped recess 65 in the other brake plate 27'''.

Figure 10:
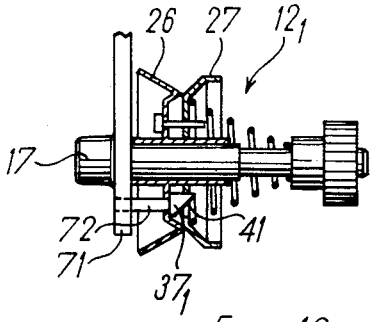
FIG. 10 shows a variant of the embodiment shown in FIG. 3.

FIG. 10 shows a variant of the embodiment of FIG. 3, wherein the yarn brake 12 has securing noses 37 and 38, which are not fixed on the brake plate 26, but which rather are secured to an extension 71 of the holder 17 by means of a pin 72. The pin 72 penetrates through a recess in the brake plate 26. A similar method of fixing on the holder 17 is also possible with the wire strap 64 shown in FIGS. 8 and 9.

If desired, the securing noses 37 and 38 in the embodiment of FIGS. 1 to 3, the securing comb 57 in the embodiment of FIGS. 4 and 5, the securing lugs 61 in the embodiment of FIGS. 6 and 7, and the wire strap 64 in the embodiment of FIGS. 8 and 9 can be either made of or coated with abrasion-proof material. The same applies to the two brake plates in the various embodiments described.

We claim:

1. A yarn tension device for a flat knitting machine, comprising a yarn brake having first and second juxtaposed brake plates, said brake plates being adapted to receive a yarn therebetween, biassing means urging at least one of the brake plates towards the other brake plate, and a securing device which defines a yarn path between said brake plates, said securing device being capable of being opened to permit the yarn to be open-threaded into said yarn path but being operative thereafter to close automatically access to said yarn path.

2. The yarn tension device according to claim 1, wherein said securing device comprises at least one securing projection extending from said first brake plate, and at least one receiver provided on said second brake plate, said at least one securing projection extending into said at least one receiver, respectively, and means permitting said brake plates to be separated against the action of said biassing means to displace said at least one securing projection out of said respective receiver and thereby open access to said yarn path.

3. The yarn tension device according to claim 2, wherein each of said brake plates has an outer periphery, and said at least one securing projection has an oblique face which is directed towards said outer peripheries of said brake plates.

4. The yarn tension device according to claim 3, wherein at least one of said brake plates has an annular edge, and said oblique face extends to a position below said annular edge.

5. The yarn tension device according to claim 3, wherein said at least one securing projection has a boundary face on a side thereof which faces away from said oblique face, said boundary face forming a border of said yarn path.

6. The yarn tension device according to claim 5, wherein said boundary face extends perpendicularly relative to said first brake plate.

7. The yarn tension device according to claim 5, wherein said boundary face extends at a small angle to a perpendicular from said first brake plate.

8. The yarn tension device according to claim 2, wherein said first brake plate is fixed, said second brake plate is movable towards and away from said first brake plate, and said biassing means acts on said second brake plate.

9. The yarn tension device according to claim 2, wherein said at least one securing projection is fixed to said first brake plate.

10. The yarn tension device according to claim 9, wherein said at least one securing projection comprises a curved wire strap.

11. The yarn tension device according to claim 9, wherein said at least one securing projection is formed integrally with said first brake plate.

12. The yarn tension device according to claim 11, wherein said first brake plate is formed from sheet metal, and said at least one securing projection is formed by at least one nose stamped out from said first brake plate.

13. The yarn tension device according to claim 11, wherein said first brake plate is formed from sheet metal, and said at least one securing projection is formed by at least one blade element stamped out from said first brake plate.

14. The yarn tension device according to claim 2, further comprising a holder for said first brake plate, and wherein said at least one securing projection is fixed to said holder and extends through said first brake plate.

15. The yarn tension device according to claim 2, wherein said second brake plate is formed from sheet metal, and said at least one receiver is formed by at least one impression in said second brake plate.

16. The yarn tension device according to claim 2, wherein said brake plate is formed from sheet material, and said at least one receiver is formed by at least one stamped-out part in said second brake plate.

17. The yarn tension device according to claim 2, wherein said at least one receiver is formed by at least one bore in said second brake plate.

18. The yarn tension device according to claim 2, wherein two of said securing projections are provided in mutually spaced relation.

19. The yarn tension device according to claim 2, wherein a single circular-shaped securing projection is provided.

20. The yarn tension device according to claim 2, further comprising a central shaft upon which said first and second brake plates are commonly mounted, said at least one securing projection determining a looping angle of said yarn on said central shaft.

21. The yarn tension device according to claim 2, wherein said at least one securing projection is provided with abrasion-proof material.

22. The yarn tension device according to claim 2, further comprising anti-rotation means to prevent relative rotation between said first and second brake plates, said anti-rotation means being formed by a pin extending from one of said brake plates and an opening provided in the other of said brake plates, said pin engaging slidably in the opening and being longer than said at least one securing projection.

23. The yarn tension device according to claim 1, wherein said brake plates are provided with abrasion-proof material.

24. The yarn tension device according to claim 1, further comprising an anti-rotation device to prevent relative rotation betwenen said brake plates.

* * * * *